US005743373A

United States Patent [19]

Strauts

[11] Patent Number: 5,743,373

[45] **Date of Patent: *Apr. 28, 1998**

[54] COIN DISCRIMINATION SENSOR AND COIN HANDLING SYSTEM

[75] Inventor: Eric Strauts, Park Ridge, Ill.

[73] Assignee: Cummins-Allison Corp., Mt. Prospect, Ill.

[ * ] Notice: The term of this patent shall not extend beyond the expiration date of Pat. No. 5,630,494.

[21] Appl. No.: 744,373

[22] Filed: Nov. 7, 1996

Related U.S. Application Data

[63] Continuation of Ser. No. 399,771, Mar. 7, 1995, Pat. No. 5,630,494.

[51] Int. Cl.[6] ..... G07D 3/14

[52] U.S. Cl. ..... 194/318; 453/10

[58] Field of Search ..... 194/317, 318, 194/319; 453/10

[56] References Cited

U.S. PATENT DOCUMENTS

| | | | |
|---|---|---|---|
| 227,453 | 7/1880 | Plester | 194/318 |
| 3,559,789 | 2/1971 | Illastie . | |
| 3,672,481 | 6/1972 | Hastie et al. . | |
| 3,788,440 | 1/1974 | Propice et al. . | |
| 3,870,137 | 3/1975 | Fougere | 194/317 |
| 3,910,394 | 10/1975 | Fujita . | |
| 3,921,003 | 11/1975 | Greene . | |
| 3,978,962 | 9/1976 | Gregory, Jr. . | |
| 3,980,168 | 9/1976 | Knight et al. . | |
| 4,234,072 | 11/1980 | Prumm . | |
| 4,254,857 | 3/1981 | Levasseur . | |
| 4,275,806 | 6/1981 | Tanaka et al. . | |
| 4,326,621 | 4/1982 | Davies . | |
| 4,353,452 | 10/1982 | Shah et al. . | |
| 4,374,557 | 2/1983 | Sugimoto et al. . | |
| 4,462,513 | 7/1984 | Dean et al. . | |
| 4,474,281 | 10/1984 | Roberts et al. . | |
| 4,483,431 | 11/1984 | Pratt . | |
| 4,538,719 | 9/1985 | Gray et al. . | |
| 4,556,140 | 12/1985 | Okada . | |
| 4,572,349 | 2/1986 | Furuya et al. | 194/318 |
| 4,579,217 | 4/1986 | Rawicz-Szcerbo | 194/317 |
| 4,667,093 | 5/1987 | MacDonald | 194/326 X |
| 4,681,204 | 7/1987 | Zimmerman | 194/317 |
| 4,696,385 | 9/1987 | Davies | 194/319 |
| 4,715,223 | 12/1987 | Kaiser et al. | 73/163 |
| 4,742,903 | 5/1988 | Trummer | 194/317 |
| 4,749,074 | 6/1988 | Ueki et al. | 194/317 |
| 4,819,780 | 4/1989 | Trummer et al. | 194/317 |
| 4,823,928 | 4/1989 | Speas | 194/217 |
| 4,838,405 | 6/1989 | Kimoto | 194/318 |
| 4,875,567 | 10/1989 | Fitton | 194/318 |
| 4,898,564 | 2/1990 | Gunn et al. | 453/3 |
| 4,963,118 | 10/1990 | Gunn et al. | 453/3 |
| 4,971,187 | 11/1990 | Furuya et al. | 174/318 |
| 4,983,820 | 1/1991 | Dias | 235/492 |
| 4,989,715 | 2/1991 | Grunig | 194/317 |
| 4,995,497 | 2/1991 | Kai et al. | 194/318 |
| 5,002,174 | 3/1991 | Yoshihara | 194/317 |
| 5,021,026 | 6/1991 | Goi | 453/40 |
| 5,033,602 | 7/1991 | Saarinen et al. | 194/334 |
| 5,040,657 | 8/1991 | Gunn et al. | 194/317 |
| 5,067,604 | 11/1991 | Metcalf | 194/203 |
| 5,078,251 | 1/1992 | Hayashi et al. | 194/318 |
| 5,141,443 | 8/1992 | Rasmussen et al. | 453/10 |
| 5,195,626 | 3/1993 | Le Hong et al. | 194/317 |
| 5,213,190 | 5/1993 | Fuyrneaux et al. | 194/317 |
| 5,293,979 | 3/1994 | Levasseur | 194/317 |
| 5,346,049 | 9/1994 | Nakajima et al. | 194/328 |
| 5,368,149 | 11/1994 | Ibarrola | 194/317 |

FOREIGN PATENT DOCUMENTS

| | | | |
|---|---|---|---|
| 227453 | 7/1987 | European Pat. Off. | 194/318 |
| 364079 | 4/1990 | European Pat. Off. . | |
| 392110 | 10/1990 | European Pat. Off. . | |
| 2117953 | 10/1983 | United Kingdom . | |

*Primary Examiner*—F. J. Bartuska
*Attorney, Agent, or Firm*—Arnold, White & Durkee

[57] ABSTRACT

A coin discrimination sensor for discriminating among desired and undesired coins, comprised of an excitation coil for producing an alternating magnetic field. These alternating magnetic fields couple to said desired and undesired coins to induce eddy-currents. The sensor also is comprised of a detection coil for detecting eddy-currents from desired and undesired coins. The detection coil produces a differential voltage corresponding to the composition of the desired and undesired coins being sensed.

7 Claims, 10 Drawing Sheets

110
112
118
122
124
126
127
128
129
130
131
132
133
134
135
136
137
138
139
140
141
142
144
150
152a
152b
152c
152d
152e
152f
152g
152h
154
154a
156
160
7
8
$1
50c
25c
10c
5c
1c
T'a'
T'b'

COIN DISCRIMINATION SENSOR AND COIN HANDLING SYSTEM

This application is a continuation of U.S. Ser. No. 08/399,771 filed Mar. 7, 1995, now U.S. Pat. No. 5,630,494.

FIELD OF THE INVENTION

The present invention relates generally to coin handling devices employing coin discrimination sensors for handling coins of mixed denominations. More particularly, the present invention relates to coin handling devices using eddy current sensors to discriminate among coins of different compositions.

BACKGROUND OF THE INVENTION

Coin handling devices of the foregoing types have employed eddy current sensors to discriminate among various coins. Note that the term "coin" is broadly used in this specification and includes any type of coin, token or object substituted therefor. An eddy current sensor includes at least one primary coil for inducing eddy currents in the coin to be analyzed. The primary coil receives an alternating voltage which correspondingly produces an alternating current in the coil. The alternating current flowing in the primary coil produces an alternating magnetic field through and around the coil as is well known in the art.

Characteristics of the alternating magnetic field depend upon a variety of factors including the frequency and amplitude of the voltage applied to the primary coil, more fully described below. The primary coil, also know as the excitation coil, inductively couples with a coin brought into proximity with the coil, thereby producing eddy currents in the coin being analyzed. Because the magnetic field from the primary coil is alternating, the corresponding eddy currents are alternating as well. The induced eddy currents are influenced by the material composition of the coin being analyzed.

The alternating eddy currents induced in the coin also produce magnetic fields of their own. These magnetic fields are detected with one or more secondary coils, also known as detection coils. Because eddy current sensors take on a transformer-like configuration, with primary and secondary coils, the primary coil also induces an alternating voltage on the secondary coil or coils. The voltage induced on the secondary coil or coils from the primary coil can be described as a common-mode voltage and must be eliminated or ignored in order to focus on the eddy current signal made up of much smaller voltages induced on the secondary coil by the eddy currents. This has previously been accomplished by processing the voltage signal from the secondary coil to eliminate the voltage induced on the secondary coil by the primary coil. Such signal processing can have the undesirable effect of increasing the number of components in the system, which correspondingly increases signal distortion and the possibility of other problems such as part failure, electrical noise and manufacturing complexity. Such signal processing may also decrease the ability to resolve fine variations in the eddy current signal.

The strength of the eddy currents produced is directly affected by the frequency of the alternating magnetic fields applied. A tradeoff exists between the use of high and low frequencies in coin discrimination. High frequencies tend to create magnetic fields that penetrate less deeply into the coin, thus making surface composition and structure more important. This can become disadvantageous when discriminating among cladded coins with designs on one or both sides. Low frequencies tend to penetrate further into the coin, giving a better indication of overall composition, but have the disadvantage of increased likelihood of causing spurious signals in material surrounding the coin in the coin handler because of the more extensive penetration of the magnetic field.

Prior art eddy current sensors have tended to be large in order to produce large magnetic fields. Coin handlers employing multiple eddy current sensors can experience cross-talk between sensors. Unfortunately, cross-talk interferes with accurate determination of coin material content.

SUMMARY OF THE INVENTION

The present invention provides an improved coin discrimination sensor for use in discriminating among coins of varying material composition.

More specifically, one embodiment of the present invention provides an improved eddy current sensor for inducing eddy currents in a particular coin within a stream of coins sequentially moving past the sensor. The eddy current sensor itself is further comprised of a single excitation (primary) coil and two detection (secondary) coils. The primary coil is energized at a particular frequency chosen to limit the extent of the alternating magnetic field surrounding coil while allowing the magnetic field to sufficiently penetrate the surface of the coin being analyzed. The two detection coils include a proximal detection coil and a distal detection coil. The entire eddy current sensor is disposed on one side of the stream of coins such that the proximal detection coil is positioned closer to the stream of coins than the distal detection coil. The proximal detection coil and the distal detection coil are positioned and connected such that the common mode voltage between them due to the excitation coil is subtracted and only a difference voltage reflecting the strength of the eddy currents in the coin remains. The difference voltage is analyzed for amplitude as well as phase relationship to the voltage applied to the excitation coil. The additional information concerning phase, combined with amplitude, allows a more accurate assessment of the composition of the coin being analyzed. The coin handler mechanically separates individual coins based on physical size, and then utilizes information from the discrimination sensor to discriminate among similarly sized coins made of different materials.

In a preferred embodiment, the eddy current sensor has a diameter that is less than that of the smallest coin to be analyzed. The small size and focused magnetic field particularly when employed in combination with magnetic shielding, reduces crosstalk between adjacent sensors in the coin handler.

DESCRIPTION OF THE PREFERRED EMBODIMENT

Figure 1:
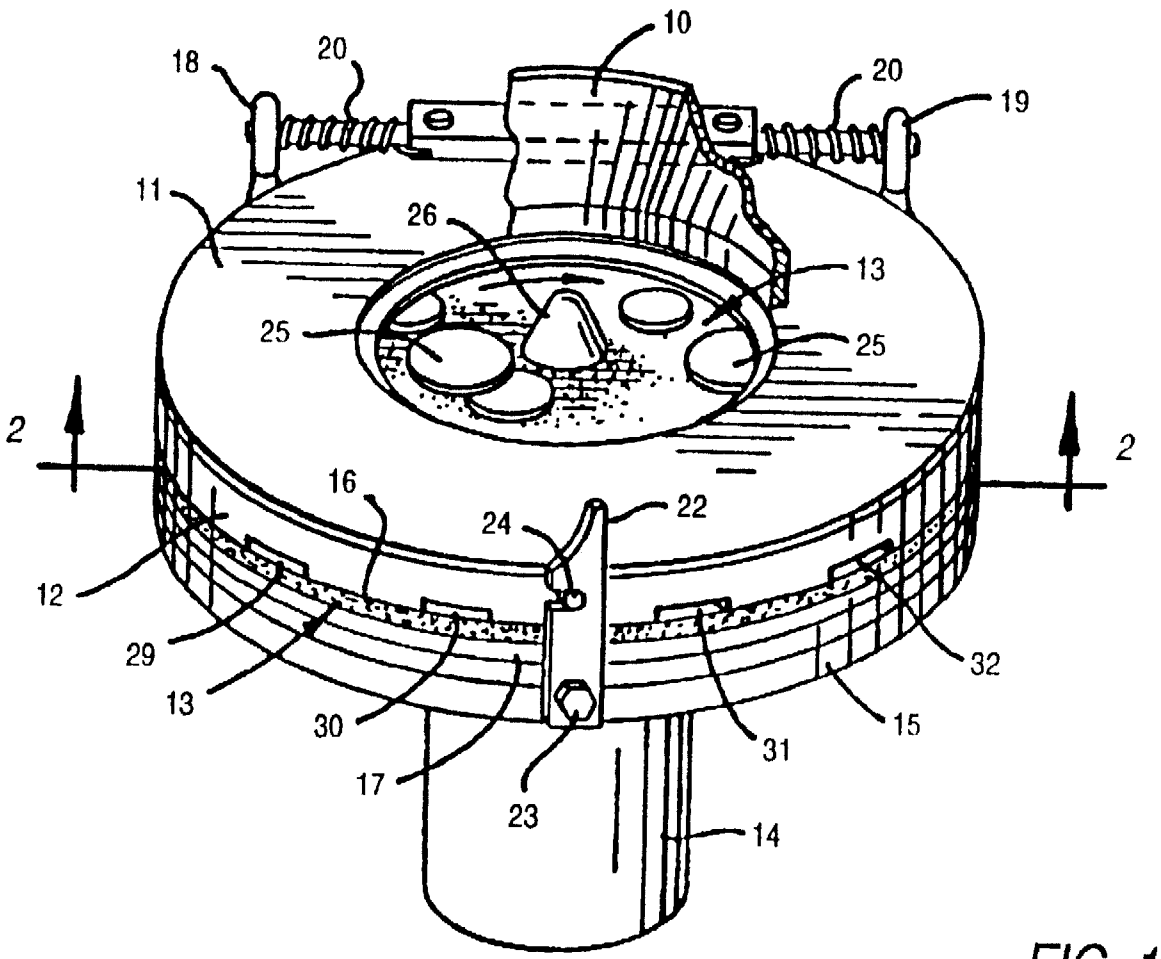
FIG. 1 is perspective view of a disc-type coin sorter embodying the present invention, with a top portion thereof broken away to show internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Although the coin discrimination sensor of the present invention can be used in a variety of different coin handling devices, it is particularly useful in high-speed coin sorters of the disc type. Thus, the invention will be described with specific reference to the use of disc-type coin sorters as the exemplary coin-handling devices in which the coin discrimination sensor is utilized.

Turning now to the drawings, FIGS. 1–8 illustrate two types of coin handling devices, including a disc-type coin sorter (FIGS. 1–4) and a disc-to-disc type coin sorter (FIGS. 5–8). Each of these types of coin handling devices uses a coin-driving member having a resilient surface for moving coins along a metal coin-guiding surface of a stationary coin-guiding member. In the disc-type coin sorter, the coin-driving member is a rotating disc and the coin-guiding member is a stationary sorting head. In the disc-to-disc type coin sorter, the coin-driving members include a pair of rotating discs and the coin-guiding members include a stationary queuing head and a stationary sorting disc.

With respect to the following detailed description, the terms "stationary plate" and "sorting plate" are defined to encompass the stationary sorting head of the disc-type coin sorter and the queuing head and sorting disc of the disc-to-disc type coin sorter.

Turning first to the disc-type coin sorter of FIG. 1, a hopper 10 receives coins of mixed denominations and feeds them through central openings in a housing 11 and a coin-guiding member in the form of an annular sorting head or guide plate 12 inside or underneath the housing. As the coins pass through these openings, they are deposited on the top surface of a coin-driving member in the form of a rotatable disc 13. This disc 13 is mounted for rotation on a stub shaft (not shown) and driven by an electric motor 14 mounted to a base plate 15. The disc 13 comprises a resilient pad 16 bonded to the top surface of a solid metal disc 17.

The top surface of the resilient pad 16 is preferably spaced from the lower surface of the sorting head 12 by a gap of about 0.005 inches (0.13 mm). The gap is set around the circumference of the sorting head 12 by a three point mounting arrangement including a pair of rear pivots 18, 19 loaded by respective torsion springs 20 which tend to elevate the forward portion of the sorting head. During normal operation, however, the forward portion of the sorting head 12 is held in position by a latch 22 which is pivotally mounted to the frame 15 by a bolt 23. The latch 22 engages a pin 24 secured to the sorting head. For gaining access to the opposing surfaces of the resilient pad 16 and the sorting head, the latch is pivoted to disengage the pin 24, and the forward portion of the sorting head is raised to an upward position (not shown) by the torsion springs 20.

As the disc 13 is rotated, the coins 25 deposited on the top surface thereof tend to slide outwardly over the surface of the pad due to centrifugal force. The coins 25, for example, are initially displaced from the center of the disc 13 by a cone 26, and therefore are subjected to sufficient centrifugal force to overcome their static friction with the upper surface of the disc. As the coins move outwardly, those coins which are lying flat on the pad enter the gap between the pad surface and the guide plate 12 because the underside of the inner periphery of this plate is spaced above the pad 16 by a distance which is about the same as the thickness of the thickest coin.

As further described below, the coins are sorted into their respective denominations, and the coins for each denomination issue from a respective exit slot, such as the slots 27, 28, 29, 30, 31 and 32 (see FIGS. 1 and 2) for dimes, pennies, nickels, quarters, dollars, and half-dollars, respectively. In general, the coins for any given currency are sorted by the variation in diameter for the various denominations.

Preferably most of the aligning, referencing, sorting, and ejecting operations are performed when the coins are pressed into engagement with the lower surface of the sorting head 12. In other words, the distance between the lower surfaces of the sorting head 12 with the passages conveying the coins and the upper surface of the rotating disc 13 is less than the thickness of the coins being conveyed. As mentioned above, such positive control permits the coin sorter to be quickly stopped by braking the rotation of the disc 13 when a preselected number of coins of a selected denomination have been ejected from the sorter. Positive control also permits the sorter to be relatively compact yet operate at high speed. The positive control, for example, permits the single file stream of coins to be relatively dense, and ensures that each coin in this stream can be directed to a respective exit slot.

Figure 2:
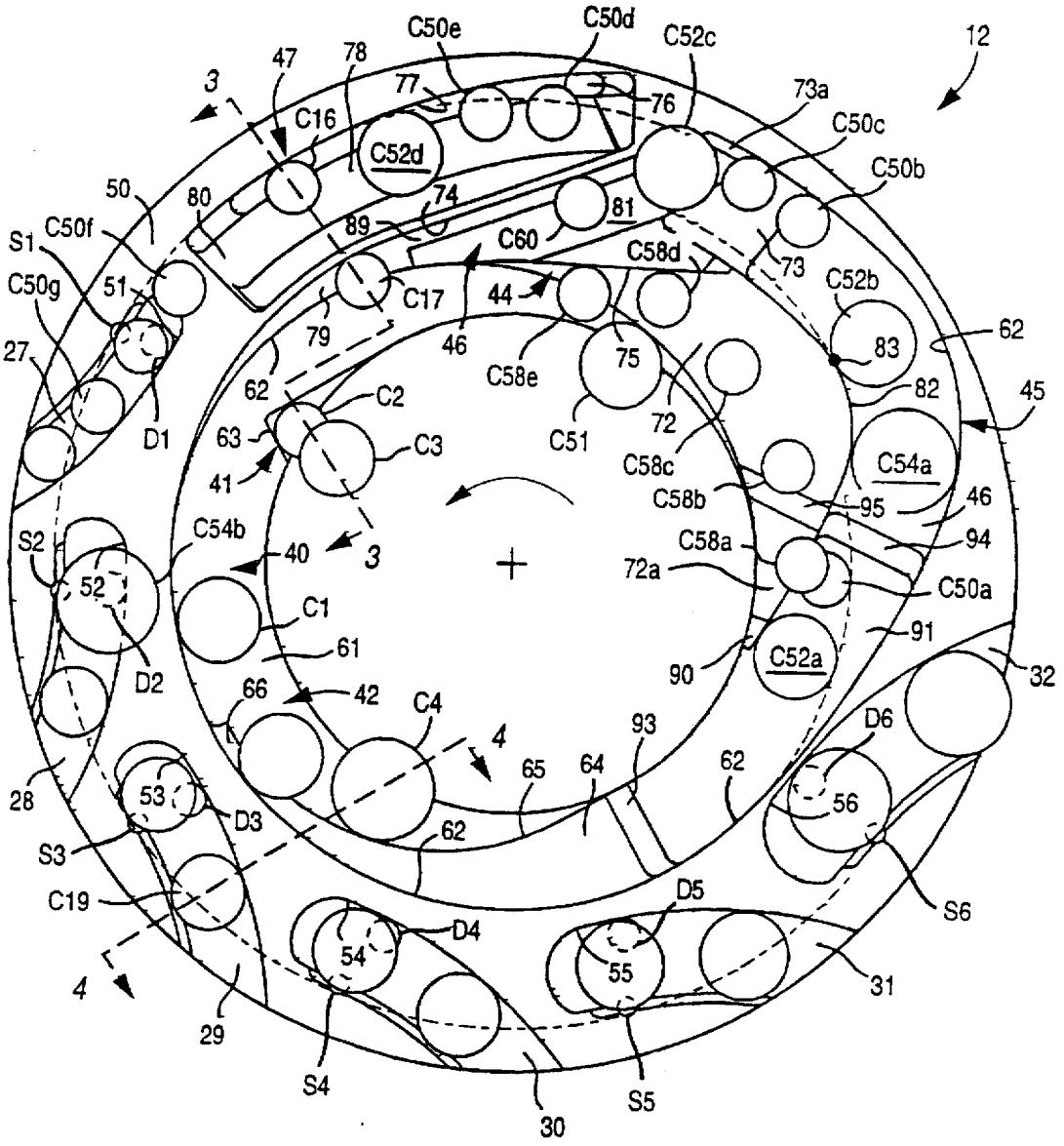
FIG. 2 is an enlarged horizontal section taken generally along line 2—2 in FIG. 1.

Turning now to FIG. 2, there is shown a bottom view of the preferred sorting head 12 including various channels and other means especially designed for high-speed sorting with positive control of the coins, yet avoiding the galling problem. It should be kept in mind that the circulation of the coins, which is clockwise in FIG. 1, appears counterclockwise in FIG. 2 because FIG. 2 is a bottom view. The various means operating upon the circulating coins include an entrance region 40, means 41 for stripping "shingled" coins, means 42 for selecting thick coins, first means 44 for recirculating coins, first referencing means 45 including means 46 for recirculating coins, second referencing means 47, and the exit means 27, 28, 29, 30, 31 and 32 for six different coin denominations, such as dimes, pennies, nickels, quarters, dollars and half-dollars. The lowermost surface of the sorting head 12 is indicated by the reference numeral 50.

Considering first the entrance region 40, the outwardly moving coins initially enter under a semi-annular region underneath a planar surface 61 formed in the underside of the guide plate or sorting head 12. Coin C1, superimposed on the bottom plan view of the guide plate in FIG. 2 is an example of a coin which has entered the entrance region 40. Free radial movement of the coins within the entrance region 40 is terminated when they engage a wall 62, though the coins continue to move circumferentially along the wall 62 by the rotational movement of the pad 16, as indicated by the central arrow in the counterclockwise direction in FIG. 2. To prevent the entrance region 40 from becoming blocked by shingled coins, the planar region 61 is provided with an inclined surface 41 forming a wall or step 63 for engaging the upper most coin in a shingled pair. In FIG. 2, for example, an upper coin C2 is shingled over a lower coin C3. As further shown in FIG. 3, movement of the upper coin C2 is limited by the wall 63 so that the upper coin C2 is forced off of the lower coin C3 as the lower coin is moved by the rotating disc 13.

Returning to FIG. 2, the circulating coins in the entrance region 40, such as the coin C1, are next directed to the means 42 for selecting thick coins. This means 42 includes a surface 64 recessed into the sorting head 12 at a depth of 0.070 inches (1.78 mm) from the lowermost surface 50 of the sorting head. Therefore, a step or wall 65 is formed between the surface 61 of the entrance region 40 and the surface 64. The distance between the surface 64 and the upper surface of the disc 13 is therefore about 0.075 inches so that relatively thick coins between the surface 64 and the disc 13 are held by pad pressure. To initially engage such thick coins, an initial portion of the surface 64 is formed with a ramp 66 located adjacent to the wall 62. Therefore, as the disc 13 rotates, thick coins in the entrance region that are next to the wall 62 are engaged by the ramp 66 and thereafter their radial position is fixed by pressure between the disc and the surface 64. Thick coins which fail to initially engage the ramp 66, however, engage the wall 65 and are therefore recirculated back within the central region of the sorting head. This is illustrated, for example, in FIG. 4 for the coin C4. This initial selecting and positioning of the thick coins prevents misaligned thick coins from hindering the flow of coins to the first referencing means 45.

Returning now to FIG. 2, the ramp 66 in the means 42 for selecting the thick coins can also engage a pair or stack of thin coins. Such a stack or pair of thin coins will be carried under pad pressure between the surface 64 and the rotating disc 13. In the same manner as a thick coin, such a pair of stacked coins will have its radial position fixed and will be carried toward the first referencing means 45. The first means 45 for referencing the coins obtains a single-file stream of coins directed against the outer wall 62 and leading up to a ramp 73.

Coins are introduced into the referencing means 45 by the thinner coins moving radially outward via centrifugal force, or by the thicker coin(s) C52*a* following concentricity via pad pressure. The stacked coins C58*a* and C50*a* are separated at the inner wall 82 such that the lower coin C58*a* is carried against surface 72*a*. The progression of the lower coin C58*a* is depicted by its positions at C58*b*, C58*c*, C58*d*, and C58*e*. More specifically, the lower coin C58 becomes engaged between the rotating disc 13 and the surface 72 in order to carry the lower coin to the first recirculating means 44, where it is recirculated by the wall 75 at positions C58*d* and C58*e*. At the beginning of the wall 82, a ramp 90 is used to recycle coins not fully between the outer and inner walls 62 and 82 and under the sorting head 12. As shown in FIG. 2, no other means is needed to provide a proper introduction of the coins into the referencing means 45.

The referencing means 45 is further recessed over a region 91 of sufficient length to allow the coins C54 of the widest denomination to move to the outer wall 62 by centrifugal force. This allows coins C54 of the widest denomination to move freely into the referencing means 45 toward its outer wall 62 without being pressed between the resilient pad 16 and the sorting head 12 at the ramp 90. The inner wall 82 is preferably constructed to follow the contour of the recess ceiling. The region 91 of the referencing recess 45 is raised into the head 12 by ramps 93 and 94, and the consistent contour at the inner wall 82 is provided by a ramp 95.

The first referencing means 45 is sufficiently deep to allow coins C50 having a lesser thickness to be guided along the outer wall 62 by centrifugal force, but sufficiently shallow to permit coins C52, C54 having a greater thickness to be pressed between the pad 16 and the sorting head 12, so that they are guided along the inner wall 82 as they move through the referencing means 45. The referencing recess 45 includes a section 96 which bends such that coins C52, which are sufficiently thick to be guided by the inner wall 82 but have a width which is less than the width of the referencing recess 45, are carried away from the inner wall 82 from a maximum radial location 83 on the inner wall toward the ramp 73.

This configuration in the sorting head 12 allows the coins of all denominations to converge at a narrow ramped finger 73*a* on the ramp 73, with coins C54 having the largest width being carried between the inner and outer walls via the surface 96 to the ramped finger 73*a* so as to bring the outer edges of all coins to a generally common radial location. By directing the coins C50 radially inward along the latter portion of the outer wall 62, the probability of coins being offset from the outer wall 62 by adjacent coins and being led onto the ramped finger 73*a* is significantly reduced. Any coins C50 which are slightly offset from the outer wall 62 while being led onto the ramp finger 73*a* may be accommodated by moving the edge 51 of exit slot 27 radially inward, enough to increase the width of the slot 27 to capture offset coins C50 but to prevent the capture of coins of the larger denominations. For sorting Dutch coins, the width of the ramp finger 73*a* may be about 0.140 inch. At the terminal end of the ramp 73, the coins become firmly pressed into the pad 16 and are carried forward to the second referencing means 47.

A coin such as the coin C50*c* will be carried forward to the second referencing means 47 so long as a portion of the coin is engaged by the narrow ramped finger 73*a* on the ramp 73. If a coin is not sufficiently close to the wall 62 so as to be engaged by this ramped finger 73*a*, then the coin strikes a wall 74 defined by the second recirculating means 46, and that coin is recirculated back to the entrance region 40.

The first recirculating means 44, the second recirculating means 46 and the second referencing means 47 are defined at successive positions in the sorting head 12. It should be apparent that the first recirculating means 44, as well as the second recirculating means 46, recirculate the coins under positive control of pad pressure. The second referencing means 47 also uses positive control of the coins to align the outer most edge of the coins with a gaging wall 77. For this purpose, the second referencing means 47 includes a surface 76, for example, at 0.110 inches (1.27 mm) from the bottom surface of the sorting head 12, and a ramp 78 which engages the inner edge portions of the coins, such as the coin C50*d*.

Figure 3:
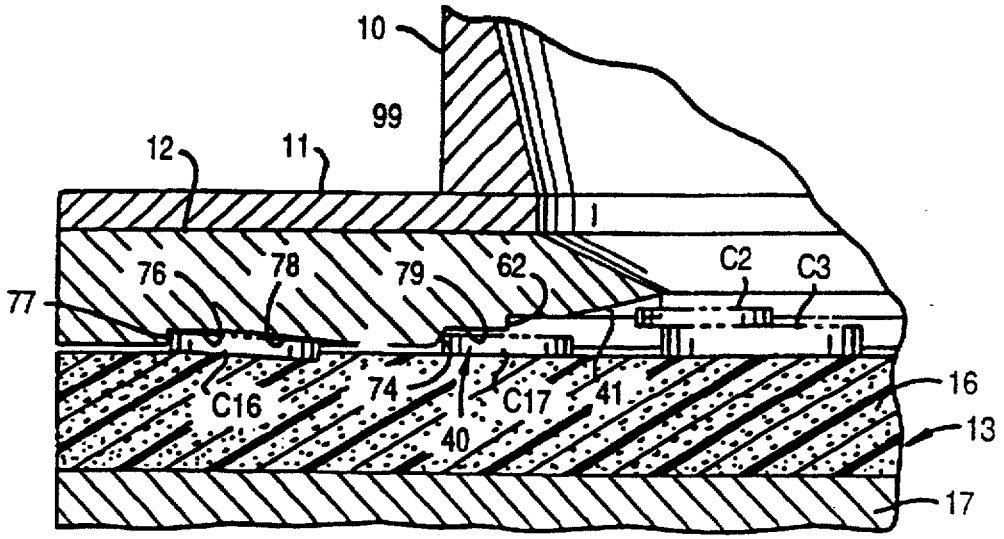
FIG. 3 is an enlarged section taken generally along line 3—3 in FIG. 2, showing the coins in full elevation.
Figure 4:
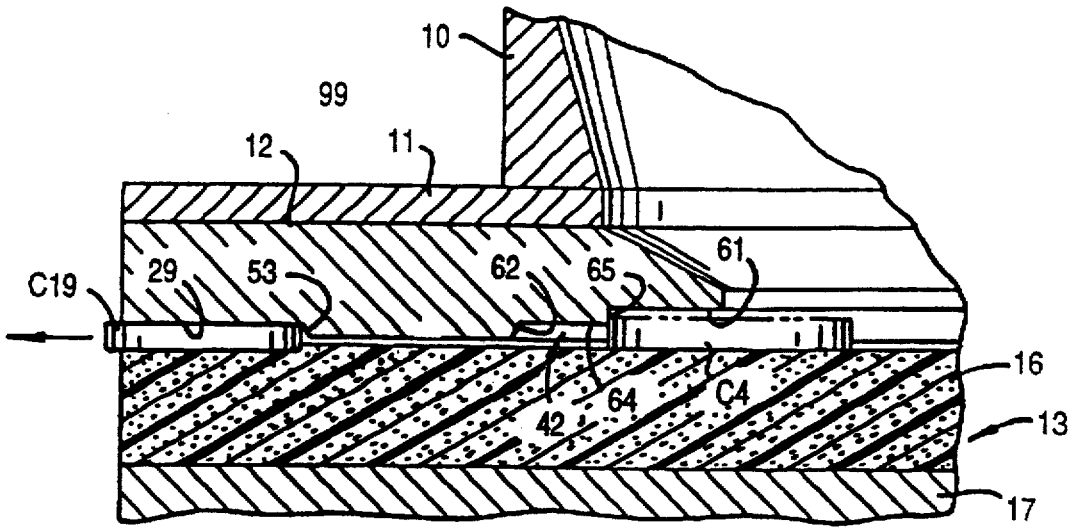
FIG. 4 is an enlarged section taken generally along line 4—4 in FIG. 2, showing in full elevation a nickel registered with an ejection recess.

As best shown in FIG. 2, the initial portion of the gaging wall 77 is along a spiral path with respect to the center of the sorting head 12 and the sorting disc 13, so that as the coins are positively driven in the circumferential direction by the rotating disc 13, the outer edges of the coins engage the gaging wall 77 and are forced slightly radially inward to a precise gaging radius, as shown for the coin C16 in FIG. 3. FIG. 3 further shows a coin C17 having been ejected from the second recirculating means 46.

Referring back to FIG. 2, the second referencing means 47 terminates with a slight ramp 80 causing the coins to be firmly pressed into the pad 16 on the rotating disc with their outer most edges aligned with the gaging radius provided by the gaging wall 77. At the terminal end of the ramp 80 the coins are gripped between the guide plate 12 and the resilient pad 16 with the maximum compressive force. This ensures that the coins are held securely in the new radial position determined by the wall 77 of the second referencing means 47.

The sorting head 12 further includes sorting means comprising a series of ejection recesses 27, 28, 29, 30, 31 and 32 spaced circumferentially around the outer periphery of the plate, with the innermost edges of successive slots located progressively farther away from the common radial location of the outer edges of all the coins for receiving and ejecting coins in order of increasing diameter. The width of each ejection recess is slightly larger than the diameter of the coin to be received and ejected by that particular recess, and the surface of the guide plate adjacent the radially outer edge of each ejection recess presses the outer portions of the coins received by that recess into the resilient pad so that the inner edges of those coins are tilted upwardly into the recess. The ejection recesses extend outwardly to the periphery of the guide plate so that the inner edges of these recesses guide the tilted coins outwardly and eventually eject those coins from between the guide plate 12 and the resilient pad 16.

The innermost edges of the ejection recesses are positioned so that the inner edge of a coin of only one particular denomination can enter each recess; the coins of all other remaining denominations extend inwardly beyond the innermost edge of that particular recess so that the inner edges of those coins cannot enter the recess.

For example, the first ejection recess 27 is intended to discharge only dimes, and thus the innermost edge 51 of this recess is located at a radius that is spaced inwardly from the radius of the gaging wall 77 by a distance that is only slightly greater than the diameter of a dime. Consequently, only dimes can enter the recess 27. Because the outer edges of all denominations of coins are located at the same radial position when they leave the second referencing means 47, the inner edges of the pennies, nickels, quarters, dollars and half dollars all extend inwardly beyond the innermost edge of the recess 27, thereby preventing these coins from entering that particular recess.

At recess 28, the inner edges of only pennies are located close enough to the periphery of the sorting head 12 to enter the recess. The inner edges of all the larger coins extend inwardly beyond the innermost edge 52 of the recess 28 so that they remain gripped between the guide plate and the resilient pad. Consequently, all the coins except the pennies continue to be rotated past the recess 28.

Similarly, only nickels enter the ejection recess 29, only the quarters enter the recess 30, only the dollars enter the recess 31, and only the half dollars enter the recess 32.

Because each coin is gripped between the sorting head 12 and the resilient pad 16 throughout its movement through the ejection recess, the coins are under positive control at all times. Thus, any coin can be stopped at any point along the length of its ejection recess, even when the coin is already partially projecting beyond the outer periphery of the guide plate. Consequently, no matter when the rotating disc is stopped (e.g., in response to the counting of a preselected number of coins of a particular denomination), those coins which are already within the various ejection recesses can be retained within the sorting head until the disc is re-started for the next counting operation.

One of six proximity sensors $S_1$–$S_6$ is mounted along the outboard edge of each of the six exit channels 27–32 in the sorting head for sensing and counting coins passing through the respective exit channels. By locating the sensors $S_1$–$S_6$ in the exit channels, each sensor is dedicated to one particular denomination of coin, and thus it is not necessary to process the sensor output signals to determine the coin denomination. The effective fields of the sensors $S_1$–$S_6$ are all located just outboard of the radius at which the outer edges of all coin denominations are gaged before they reach the exit channels 27–32, so that each sensor detects only the coins which enter its exit channel and does not detect the coins which bypass that exit channel. Only the largest coin denomination (e.g., U.S. half dollars) reaches the sixth exit channel 32, and thus the location of the sensor in this exit channel is not as critical as in the other exit channels 27–31.

In addition to the proximity sensors S1–S6, each of the exit channels 27–32 also includes one of six coin discrimination sensors D1–D6. These sensors D1–D6 are the eddy current sensors, and will be described in more detail below in connection with FIGS. 9–12 of the drawings.

When one of the discrimination sensors detects a coin material that is not the proper material for coins in that exit channel, the disc may be stopped by de-energizing or disengaging the drive motor and energizing a brake. The suspect coin may then be discharged by jogging the drive motor with one or more electrical pulses until the trailing edge of the suspect coin clears the exit edge of its exit channel. The exact disc movement required to move the trailing edge of a coin from its sensor to the exit edge of its exit channel, can be empirically determined for each coin denomination and then stored in the memory of the control system. An encoder on the sorter disc can then be used to measure the actual disc movement following the sensing of the suspect coin, so that the disc can be stopped at the precise position where the suspect coin clears the exit edge of its exit channel, thereby ensuring that no coins following the suspect coin are discharged.

Figure 5:
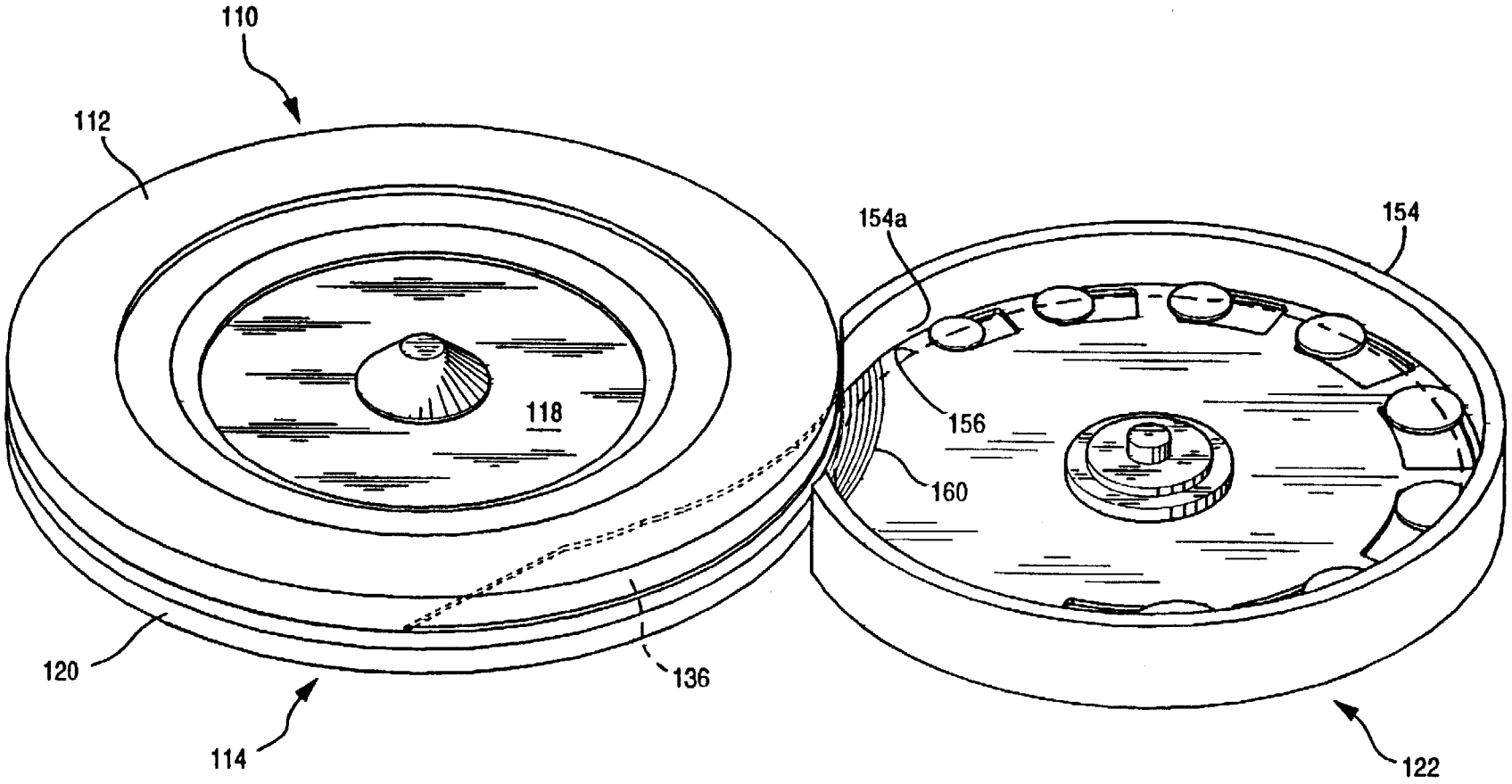
FIG. 5 is perspective view of a disc-to-disc type coin sorter embodying the present invention.

FIG. 5 illustrates a disc-to-disc type coin sorter including a queuing device 110 having a hopper which receives coins of mixed denominations. The hopper feeds the coins through a central feed aperture in a coin-guiding member in the form of an annular queuing head or guide plate 112. As the coins pass through the feed aperture, they are deposited on the top surface of a coin-driving member in the form of a rotatable disc 114. This disc 114 is mounted for rotation on a stub shaft (not shown) driven by an electric motor (not shown). The disc 114 comprises a resilient pad 118, preferably made of a resilient rubber or polymeric material, bonded to the top surface of a solid metal plate 120.

As the disc 114 is rotated (in the counterclockwise direction as viewed in FIG. 6), the coins deposited on the top surface thereof tend to slide outwardly over the surface of the pad 118 due to centrifugal force. As the coins move outwardly, those coins which are lying flat on the pad 118 enter the gap between the pad surface and the queuing head 112 because the underside of the inner periphery of this head 112 is spaced above the pad 118 by a distance which is approximately the same as the thickness of the thickest coin.

Figure 6:
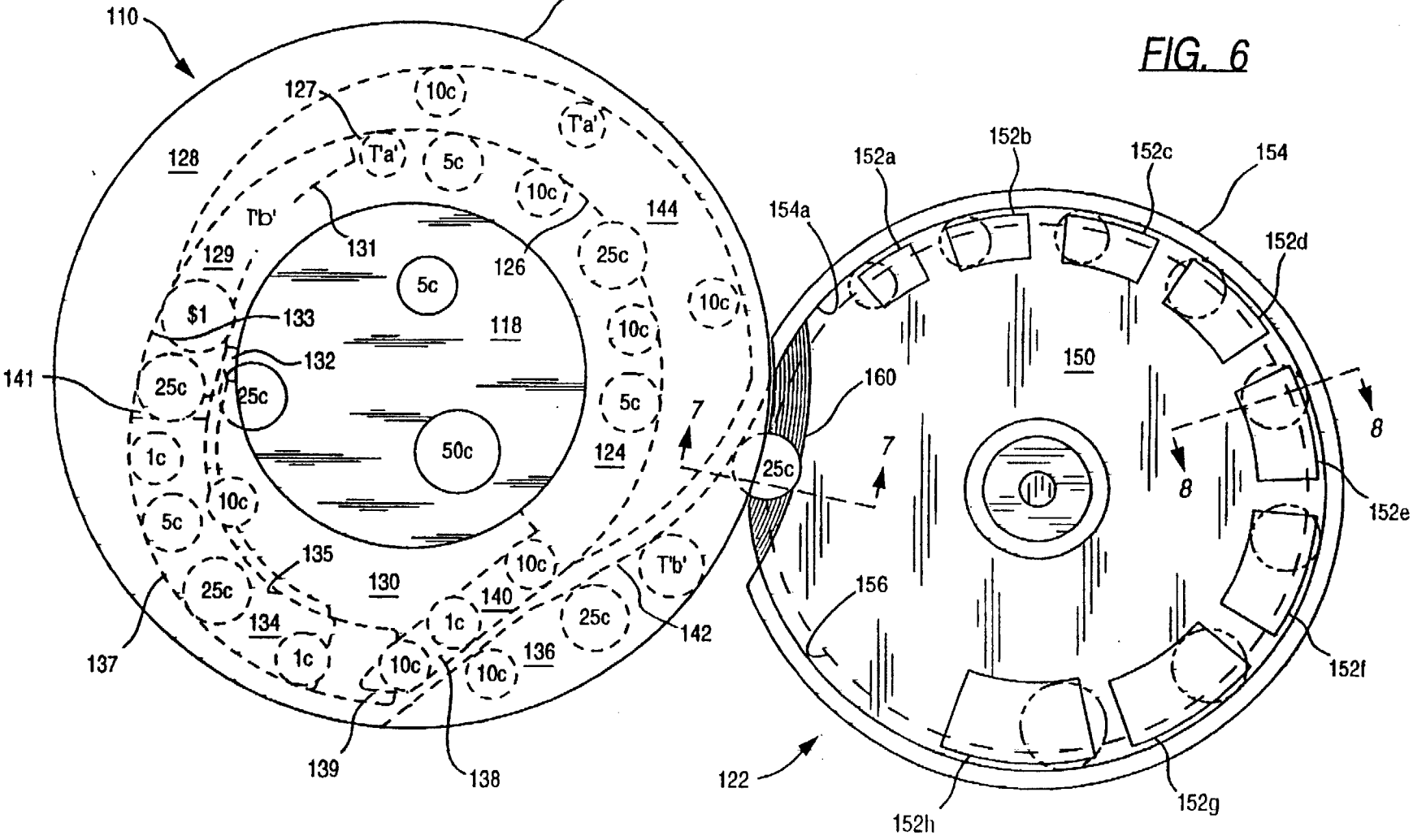
FIG. 6 is a top plan view of the arrangement in FIG. 5.

As can be seen most clearly in FIG. 6, the outwardly moving coins initially enter an annular recess 124 formed in the underside of the queuing head 112 and extending around a major portion of the inner periphery of the queuing head 112. To permit radial movement of coins entering the recess 124, the recess 124 has an upper surface spaced from the top surface of the pad 118 by a distance which is greater than the thickness of the thickest coin. An upstream outer wall 126 of the recess 124 extends downwardly to the lowermost surface 128 of the queuing head 112, which is preferably spaced from the top surface of the pad 118 by a distance (e.g., 0.010 inch) which is significantly less (e.g., 0.010 inch) than the thickness of the thinnest coin. Consequently, the initial radial movement of the coins is terminated when they engage the upstream outer wall 126 of the recess 124, though the coins continue to move circumferentially along the wall 126 by the rotational movement of the pad 118.

A ramp 127 is formed at the downstream end of the outer wall 126. Coins which are engaged to the wall 126 prior to reaching the ramp 127 are moved by the rotating pad 118 into a channel 129. For example, the coin T'a' at approximately the 12 o'clock position in FIG. 6 will be moved by the rotating pad 118 into the channel 129. However, those coins which are still positioned radially inward from the outer wall 126 prior to reaching the ramp 127 engage a recirculation wall 131, which prevents the coins from entering the channel 129. Instead, the coins are moved along the recirculation wall 131 until they reach a ramp 132 formed at the upstream end of a land 130.

The only portion of the central opening of the queuing head 112 which does not open directly into the recess 124 is that sector of the periphery which is occupied by the land 130. The land 130 has a lower surface which is co-planar with or at a slightly higher elevation than the lowermost surface 128 of the queuing head 112. Coins initially deposited on the top surface of the pad 118 via its central feed aperture do not enter the peripheral sector of the queuing head 112 located beneath the land 130 because the spacing between the land 130 and the pad 118 is slightly less than the thickness of the thinnest coin.

When a coin has only partially entered the recess 124 (i.e., does not engage the ramp 127) and moves along the recirculation wall 131, the coin is recirculated. More specifically, an outer portion of the coin engages the ramp 132 on the leading edge of the land 130. For example, a 25 cent coin at approximately the 9 o'clock position in FIG. 6 is illustrated as having engaged the ramp 132. The ramp 132 presses the outer portion of the coin downwardly into the resilient pad 118 and causes the coin to move downstream in a concentric path beneath the inner edge of the land 130 (i.e., inner periphery of the queuing head 112) with the outer portion of the coin extending beneath the land 130. After reaching the downstream end of the land 130, the coin reenters the recess 124 so that the coin can be moved by the rotating pad 118 through the recess 124 and into the channel 129.

Coins which engage the ramp 127 enter the channel 129, defined by the inner wall 131 and an outer wall 133. The outer wall 133 has a constant radius with respect to the center of the disc 114. Since the distance between the upper surface of the channel 129 and the top surface of the rotating pad 118 is only slightly less than the thickness of the thinnest coin, the coins move downstream in a concentric path through the channel 129. To prevent galling of the surface of the channel 129 as the coins move downstream therethrough, the channel 129 is provided with the lubricant-filled cavities 146. While moving downstream, the coins maintain contact with the outer wall 133. At the downstream end of the channel 129, the coins move into a spiral channel 134 via a ramp 141. The distance between the upper surface of the spiral channel 134 and the top surface of the pad 118 is slightly greater than the thickness of the thickest coin, thereby causing the coins to maintain contact with an outer spiral wall 137 of the channel 134 while moving downstream through the channel 134. The spiral channel 134 guides the coins to an exit channel 136. At the downstream end of the outer spiral wall 137, i.e., at the point where the spiral wall 137 reaches its maximum radius, the coins engage a ramp 139 which presses the coins downwardly into the resilient surface of the rotating pad 118. The outer edges of coins which are against the outer wall 137 have a common radial position and are ready for passage into the exit channel 136. Coins whose radially outer edges are not engaged by the ramp 139 engage a wall 138 of a recycling channel 140 which guides such coins back into the entry recess 124 for recirculation.

The spiral channel 134 strips apart most stacked or shingled coins entering the channel 134 from the channel 129. While a pair of stacked or shingled coins are moving through the channel 129, the combined thickness of the stacked or shingled coins is usually great enough to cause the lower coin in that pair to be pressed into the resilient pad 118. As a result, that pair of coins will be rotated concentrically with the disc through the channel 129 and into the channel 134. Because the inner wall 135 of the channel 134 spirals outwardly, the upper coin will eventually engage the upper vertical portion of the inner wall 135, and the lower coin will pass beneath the wall 135 and beneath the land 130. This lower coin will then be rotated concentrically with the disc beneath the land 130 and recirculated back to the entry recess 124 of the queuing head 112. If, however, the combined thickness of the stacked or shingled coins is not great enough to cause the lower coin in the pair to be pressed into the pad 118 (e.g., two very thin foreign coins), the coins are stripped apart in the exit channel 136 as described below.

The exit channel 136 causes all coins which enter the channel 136, regardless of different thicknesses and/or diameters, to exit the channel 136 with a common edge (the inner edges of all coins) aligned at the same radial position so that the opposite (outer) edges of the coins can be used for sorting in the circular sorting device 122. The upper surface of the channel 136 is recessed slightly from the lowermost surface 128 of the queuing head 112 so that the inner wall 142 of the channel 136 forms a coin-guiding wall. This upper surface, however, is close enough to the pad surface to press coins of all denominations into the resilient pad 118. While the rotating pad 118 moves the coins through the exit channel 136, the lubricant-filled cavities 146 prevent the coins from galling the surface of the exit channel 136.

As coins are advanced through the exit channel 136, they follow a path that is concentric with the center of rotation of the disc 114 in FIG. 5 because the coins of all denominations are continuously pressed firmly into the resilient disc surface. Because the coins are securely captured by this pressing engagement, there is no need for an outer wall to contain coins within the exit channel 136. The inner edges of coins of all denominations eventually engage the inner wall 142, which then guides the coins outwardly to the periphery of the disc. As can be seen in FIG. 6, a downstream section of the inner wall 142 of the exit channel 136 forms the final gaging wall for the inner edges of the coins as the coins exit the queuing head 112.

The exit channel 136 strips apart stacked or shingled coins which are not stripped apart by the spiral channel 134. The combined thickness of any pair of stacked or shingled coins is great enough to cause the lower coin in that pair to be pressed into the resilient pad 118. Consequently, that pair of coins will be rotated concentrically with the disc. Because the inner wall 142 of the exit channel 136 spirals outwardly, the upper coin will eventually engage the upper vertical portion of the inner wall 142, and the lower coin will pass beneath the wall 142. This lower coin will be passed into a recirculating channel 144, which functions like the entry recess 124 to guide the coin downstream into the channel 129.

In the preferred embodiment, the queuing device 110 is used to feed the circular sorting device 122 (see FIG. 5). Thus, in FIG. 6 the coins are sorted by passing the coins over a series of apertures formed around the periphery of a coin-guiding member in the form of a stationary sorting plate or disc 150. The apertures **152*a*–152*h* are of progressively increasing radial width so that the small coins are removed before the larger coins. The outboard edges of all the apertures 152*a*–152*h* are spaced slightly away from a cylindrical wall 154 extending around the outer periphery of the disc 150 for guiding the outer edges of the coins as the coins are advanced over successive apertures. The disc surface between the wall 154 and the outer edges of the apertures 152*a*–152*h* provides a continuous support for the outer portions of the coins. The inner portions of the coins are also supported by the disc 150 until each coin reaches its aperture, at which point the inner edge of the coin tilts downwardly and the coin drops through its aperture. Before reaching the aperture 152*a*, the coins are radially moved slightly inward by the wall 154 to insure accurate positioning of the coins after they are transferred from the queuing device 110 to the circular sorting device 122**.

Figure 8:
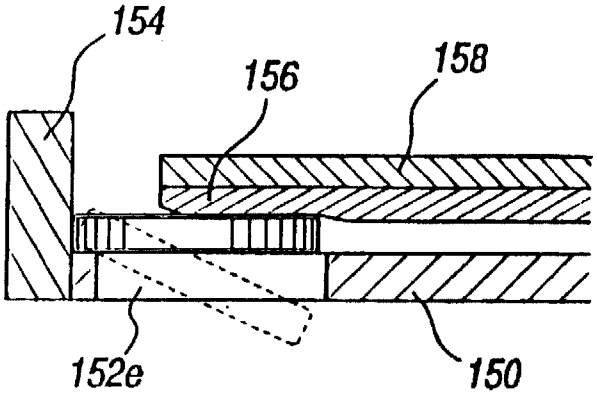
FIG. 8 is an enlarged section taken generally along the line 8—8 in FIG. 6.
Figure 7:
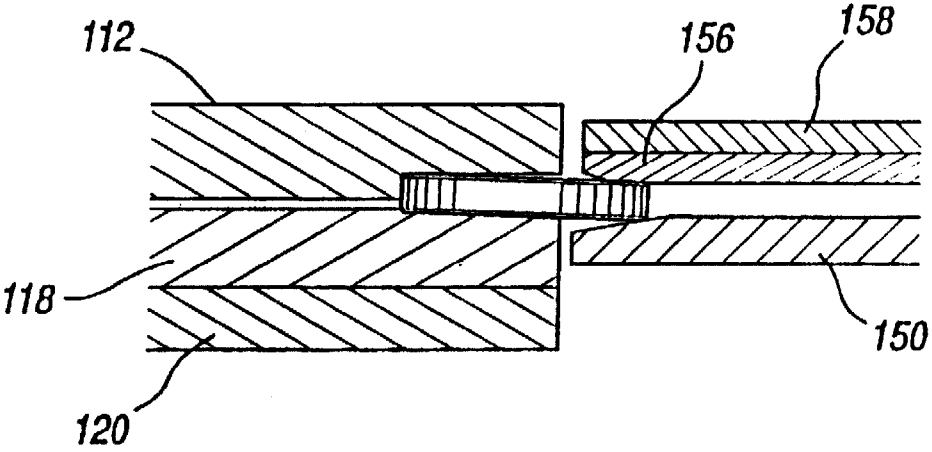
FIG. 7 is an enlarged section taken generally along the line 7—7 in FIG. 6.

To advance the coins along the series of apertures **152*a*–152*h*, the upper surfaces of the coins are engaged by a resilient rubber pad 156 attached to the lower surface of a coin-driving member in the form of a rotating disc 158 (FIGS. 7 and 8). As viewed in FIG. 6, the disc 158 is rotated clockwise. Alternatively, the pad 156 in FIGS. 7 and 8 may be substituted with a resilient rubber ring attached to the outer periphery of the lower surface of the rotating disc 158. The lower surface of the rubber pad 156 is spaced sufficiently close to the upper surface of the disc 150 that the rubber pad 156 presses coins of all denominations, regardless of coin thickness, firmly down against the surface of the disc 150 while advancing the coins concentrically around the peripheral margin of the disc 150. Consequently, when a coin is positioned over the particular aperture 152 through which that coin is to be discharged, the resilient rubber pad 156 presses the coin down through the aperture (FIG. 8**).

As can be seen in FIG. 6, a coin discrimination sensor D is mounted in the disc 150 upstream of the sorting apertures **152*a*–152*q*. Because the coins have not yet been sorted when they traverse the discrimination sensor D, this sensor merely serves to determine whether a passing coin has a composition corresponding to one of the coin denominations being sorted. If the answer is negative, the driven disc 158** may be stopped to permit removal of the unwanted coin, or the operator may simply be alerted to the fact that an unwanted coin has been detected.

As can be seen in FIG. 6, an arc-shaped section of the stationary disc 150 is cut away at a location adjacent the queuing device 110 to permit a smooth transition between the exit channel 136 and sorting device 122. Because of this cut-away section, coins which are advanced along the exit channel 136 formed by the queuing head 112 are actually engaged by the rubber pad 156 before the coins completely leave the disc 114. As each coin approaches the periphery of the disc 114, the outer portion of the coin begins to project beyond the disc periphery. This projection starts earlier for large-diameter coins than for small-diameter coins. As can be seen in FIG. 7, the portion of a coin that projects beyond the disc 114 eventually overlaps the support surface formed by the stationary sorting disc 150. When a coin overlaps the disc 150, the coin also intercepts the path of the rubber pad 156. The outer portion of the coin is engaged by the rubber pad 156 (FIG. 7).

Each coin is positioned partly within the queuing device 110 and partly within the sorting device 122 for a brief interval before the coin is actually transferred from the queuing device 110 to the sorting device 122. As can be seen in FIG. 6, the coin-guiding inner wall 142 of the exit channel 136 in the queuing head 112 begins to follow an extension of the inner surface **154*a* of the wall 154 at the exit end of the queuing head 112, so that the inboard edges of the coins on the disc 114 (which become the outboard edges of the coins when they are transferred to the disc 150) are smoothly guided by the inner wall 142 of the exit channel 136 and then the inner surface 154*a* of the wall 154 as the coins are transferred from the disc 114 to the disc 150**.

As previously stated, the exit channel 136 has such a depth that the coins of all denominations are pressed firmly down into the resilient pad 118. The coins remain so pressed until they leave the queuing device 110. This firm pressing of the coins into the pad 118 ensures that the coins remain captured during the transfer process, i.e., ensuring that the coins do not fly off the disc 114 by centrifugal force before they are transferred completely to the stationary disc 150 of the sorting device 122.

To facilitate the transfer of coins from the disc 114 to the disc 150, the outer edge portion of the top surface of the disc 150 is tapered at 160 (see FIG. 7). Thus, even though the coins are pressed into the pad 118, the coins do not catch on the edge of the disc 150 during the coin transfer.

Turning now to FIGS. 9–12, one embodiment of the present invention employs an eddy current sensor 210 to perform as the coin handling system's coin discrimination sensors D1–D6. The eddy current sensor 210 includes an excitation coil 212 for generating an alternating magnetic field used to induce eddy currents in a coin 214. The excitation coil 212 has a start end 216 and a finish end 218. An embodiment an a–c. excitation coil voltage $V_{ex}$, e.g., a sinusoidal signal of 250 KHz and 10 volts peak-to-peak, is applied across the start end 216 and the finish end 218 of the excitation coil 212. The alternating voltage $V_{ex}$ produces a corresponding current in the excitation coil 212 which in turn produces a corresponding alternating magnetic field. The alternating magnetic field exists within and around the excitation coil 212 and extends outwardly to the coin 214. The magnetic field penetrates the coin 214 as the coin is moving in close proximity to the excitation coil 212, and eddy currents are induced in the coin 214 as the coin moves through the alternating magnetic field. The strength of the eddy currents flowing in the coin 214 is dependent on the material composition of the coin, and particularly the electrical resistance of that material. Resistance affects how much current will flow in the coin 114 according to Ohm's Law (voltage=current*resistance).

The eddy currents themselves also produce a corresponding magnetic field. A proximal detector coil 222 and a distal coil 224 are disposed above the coin 214 so that the eddy current-generated magnetic field induces voltages upon the coils 222, 224. The distal detector coil 224 is positioned above the coin 214, and the proximal detector coil 222 is positioned between the distal detector coil 224 and the passing coin 214.

In one embodiment, the excitation coil 212, the proximal detector coil 222 and the distal detector coil 224 are all wound in the same direction (either clockwise or counterclockwise). The proximal detection coil 222 and the distal detector coil 224 are wound in the same direction so that the voltages induced on these coils by the eddy currents are properly oriented.

The proximal detection coil 222 has a starting end 226 and a finish end 228. Similarly, the distal coil 224 has a starting end 230 and a finish end 132. In order of increasing distance from the coin 114, the detector coils 222, 224 are positioned as follows: finish end 228 of the proximal detector coil 222, start end 226 of the proximal detector coil 222, finish end 232 of the distal detector coil 224 and start end 230 of the distal detector coil 224. As shown in FIG. 12, the finish end 228 of the proximal detection coil 222 is connected to the finish end 232 of the distal detector coil 224 via a conductive wire 234. It will be appreciated by those skilled in the art that other detector coil 222, 224 combinations are possible. For example, in an alternative embodiment the proximal detection coil 222 is wound in the opposite direction of the distal detection coil 224. In this case the start end 226 of the proximal coil 222 is connected to the finish end 232 of the distal coil 224.

Eddy currents in the coin 214 induce voltages $V_{prox}$ and $V_{dist}$ respectively on the detector coils 222, 224. Likewise, the excitation coil 212 also induces a common-mode voltage $V_{com}$ on each of the detector coils 222, 224. The common-mode voltage $V_{com}$ is effectively the same on each detector coil due to the symmetry of the detector coils' physical arrangement within the excitation coil 212. Because the detector coils 222, 224 are wound and physically oriented in the same direction and connected at their finish ends 228, 232, the common-mode voltage $V_{com}$ induced by the excitation coil 212 is subtracted out, leaving only a difference voltage $V_{diff}$ corresponding to the eddy currents in the coin 214. This eliminates the need for additional circuitry to subtract out the common-mode voltage $V_{com}$. The common-mode voltage $V_{com}$ is effectively subtracted out because both the distal detection coil 224 and the proximal detection coil 222 receive the same level of induced voltage $V_{com}$ from the excitation coil 212.

Unlike the common-mode voltage, the voltages induced by the eddy current in the detector coils are not effectively the same. This is because the proximal detector coil 222 is purposely positioned closer to the passing coin than the distal detector coil 224. Thus, the voltage induced in the proximal detector coil 222 is significantly stronger, i.e. has greater amplitude, than the voltage induced in the distal detector coil 224. Although the present invention subtracts the eddy current-induced voltage on the distal coil 224 from the eddy current-induced voltage on the proximal coil 222, the voltage amplitude difference is sufficiently great to permit detailed resolution of the eddy current response.

Figure 9:
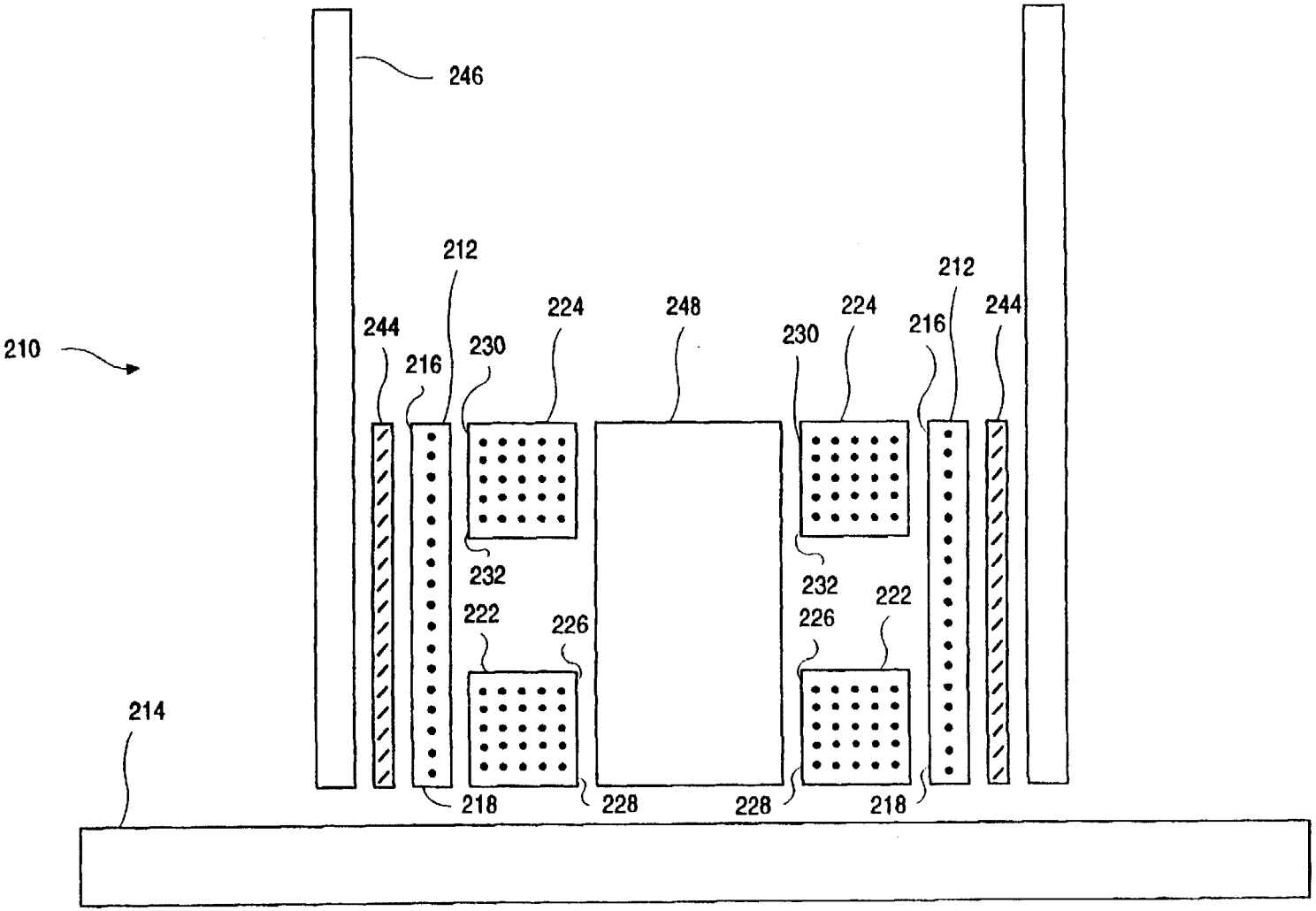
FIG. 9 is a diagrammatic cross-section of a coin and an improved coin discrimination sensor embodying the invention.
Figure 10:
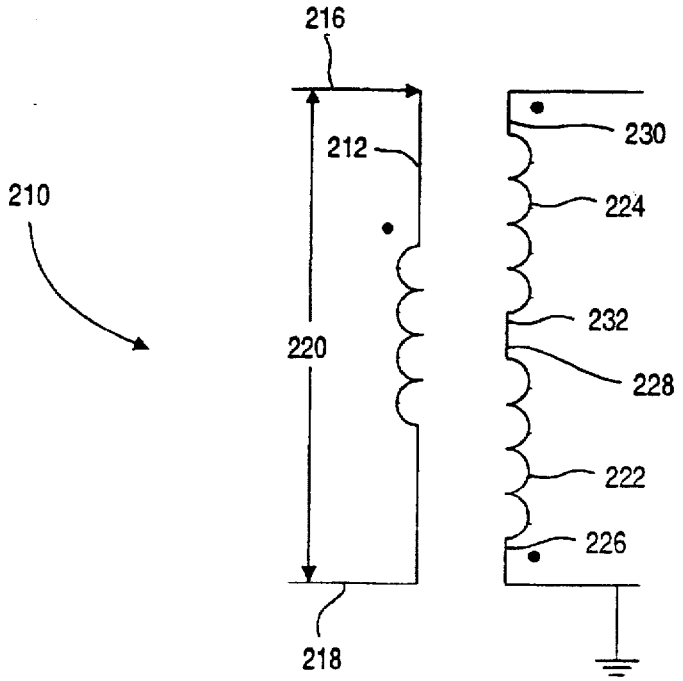
FIG. 10 is a schematic circuit diagram of the coin discrimination sensor of FIG. 9.
Figure 11:
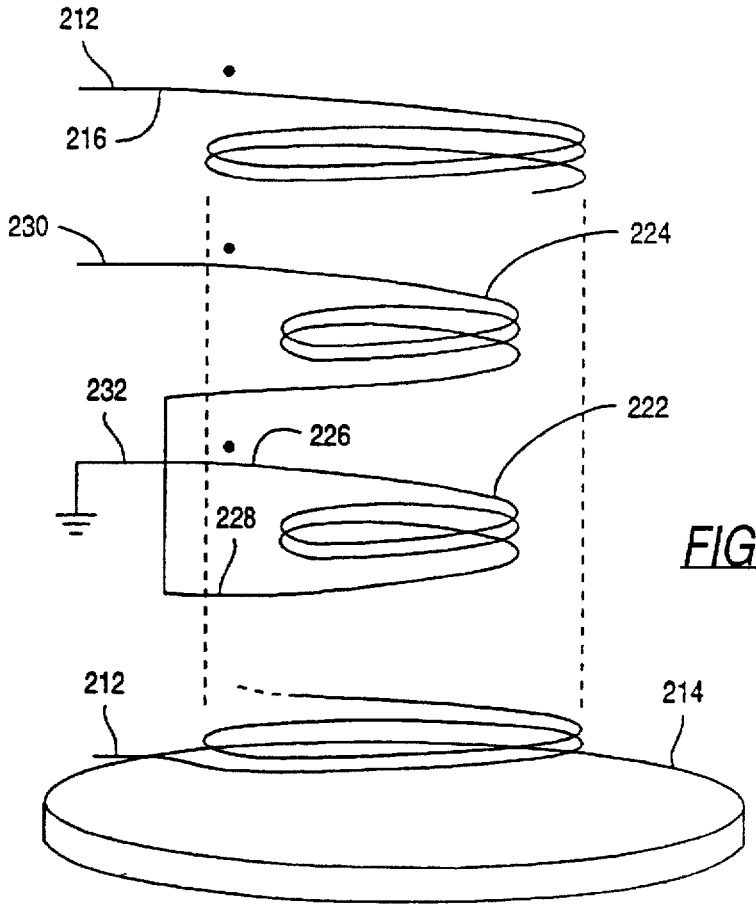
FIG. 11 is a diagrammatic perspective view of the coils in the coin discrimination sensor of FIG. 9.

As seen in FIG. 9, the excitation coil 212 is radially surrounded by a magnetic shield 234. The magnet shield 234 has a high level of magnetic permeability in order to help contain the magnetic field surrounding the excitation coil 212. The magnetic shield 234 has the advantage of preventing stray magnetic field from interfering with other nearby eddy current sensors. The magnetic shield is itself radially surrounded by a steel outer case 236.

In one embodiment the excitation coil utilizes a cylindrical ceramic (e.g., alumina) core 238. Alumina has the advantages of being impervious to humidity and providing a good wear surface. It is desirable that the core 248 be able to withstand wear because it may come into frictional contact with the coin 214. Alumina withstands frictional contact well because of its high degree of hardness, i.e., approximately 9 on mohs scale.

To form the eddy current sensor 10, the detection coils 222, 224 are wound on a coil form (not shown). A preferred form is a cylinder having a length of 0.5 inch, a maximum diameter of 0.2620 inch, a minimum diameter of 0.1660 inch, and two grooves of 0.060 inch width spaced apart by 0.060 inch and spaced from one end of the form by 0.03 inch. Both the proximal detection coil 222 and the distal detector coil 224 have 350 turns of #44 AWG enamel covered magnet wire layer wound to generally uniformly fill the available space in the grooves. Each of the detector coils 222, 224 are wound in the same direction with the finish ends 228, 232 being connected together by the conductive wire 234. The start ends 226, 230 of the detector coils 222, 224 are connected to separately identified wires in a connecting cable.

The excitation coil 212 is a generally uniformly layer wound on a cylindrical alumina ceramic coil form having a length of 0.5 inch, an outside diameter of 0.2750 inch, and a wall thickness of 0.03125 inch. The excitation coil 212 is wound with 135 turns of #42 AWG enamel covered magnet wire in the same direction as the detector coils 222, 224. The excitation coil voltage $V_{ex}$ is applied across the start end 216 and the finish end 218.

After the excitation coil 212 and detector coils 222, 224 are wound, the excitation coil 212 is slipped over the detector coils 222, 224 around a common center axis. At this time the sensor 210 is connected to a test oscillator (not shown) which applies the excitation voltage $V_{ex}$ to the excitation coil 212. The excitation coil's position is adjusted along the axis of the coil to give a null response from the detector coils 222, 224 on an a–c. voltmeter with no metal near the coil windings.

Then the magnetic shield 144 is the slipped over the excitation coil 212 and adjusted to again give a null response from the detector coils 222, 224.

The magnetic shield 244 and coils 212, 222, 224 within the magnetic shield 244 are then placed in the steel outer case 246 and encapsulated with a polymer resin (not shown) to "freeze" the position of the magnetic shield 244 and coils 212, 222, 224.

After curing the resin, an end of the eddy current sensor 210 nearest the proximal detector coil 222 is sanded and lapped to produce a flat and smooth surface with the coils 212, 222 slightly recessed within the resin.

In order to detect the effect of the coin 214 on the voltages induced upon the detector coils 222, 224, it is preferred to use a combination of phase and amplitude analysis of the detected voltage. This type of analysis minimizes the effects of variations in coin surface geometry and in the distance between the coin and the coils.

The voltage applied to the excitation coil 212 causes current to flow in the coil 212 which lags behind the voltage 220. For example, the current may lag the voltage 220 by 90 degrees in a superconductive coil. In effect, the coin's 214 eddy currents impose a resistive loss on the current in the excitation coil 212. Therefore, the initial phase difference between the voltage and current in the excitation coil 212 is decreased by the presence of the coin 214. Thus, when the detector coils 224, 226 have a voltage induced upon them, the phase difference between the voltage applied to the excitation coil 212 and that of the detector coils is reduced due to the eddy current effect in the coin. The amount of reduction in the phase difference is proportional to the electrical and magnetic characteristics of the coin and thus the composition of the coin. By analyzing both the phase difference and the maximum amplitude, an accurate assessment of the composition of the coin is achieved.

Figure 12A:
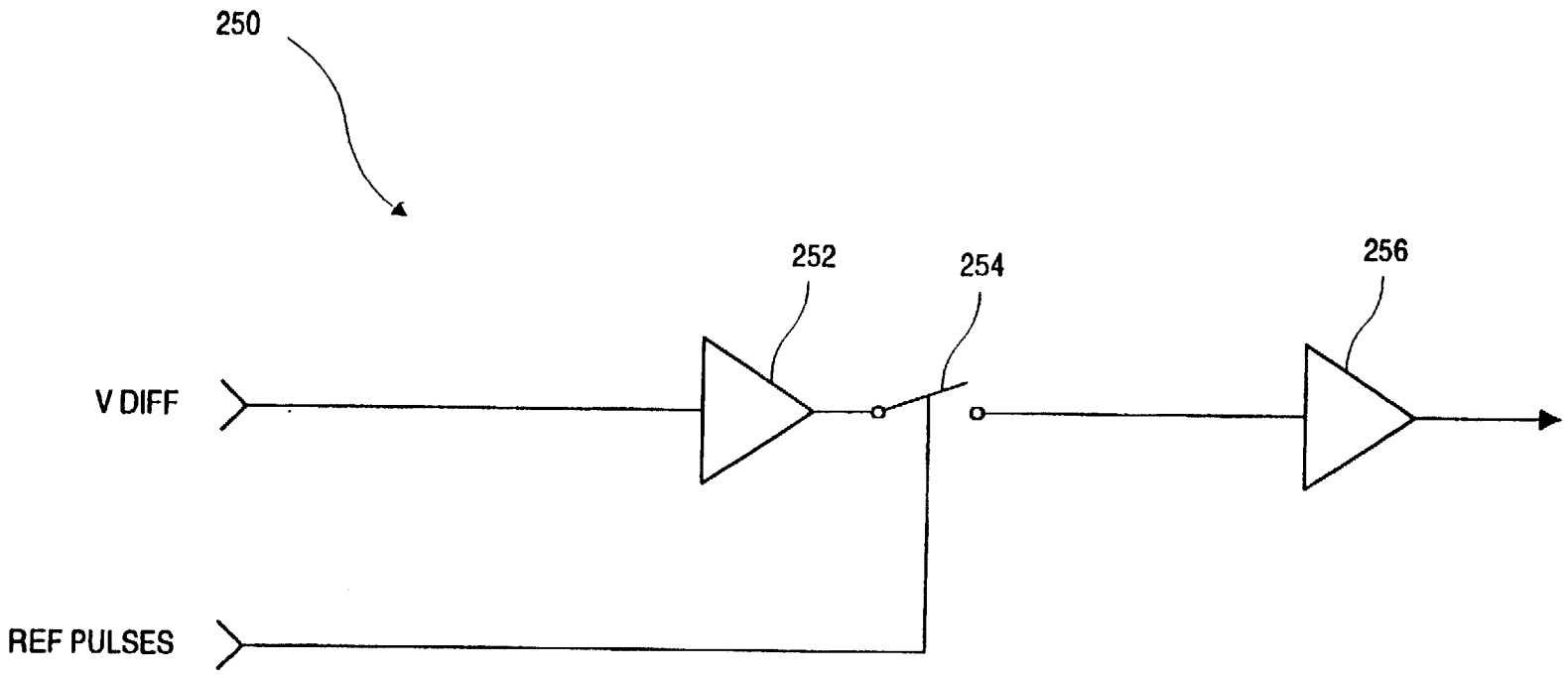
FIG. 12A is a circuit diagram of a detector circuit for use with the discrimination sensor of this invention.
Figure 12B:
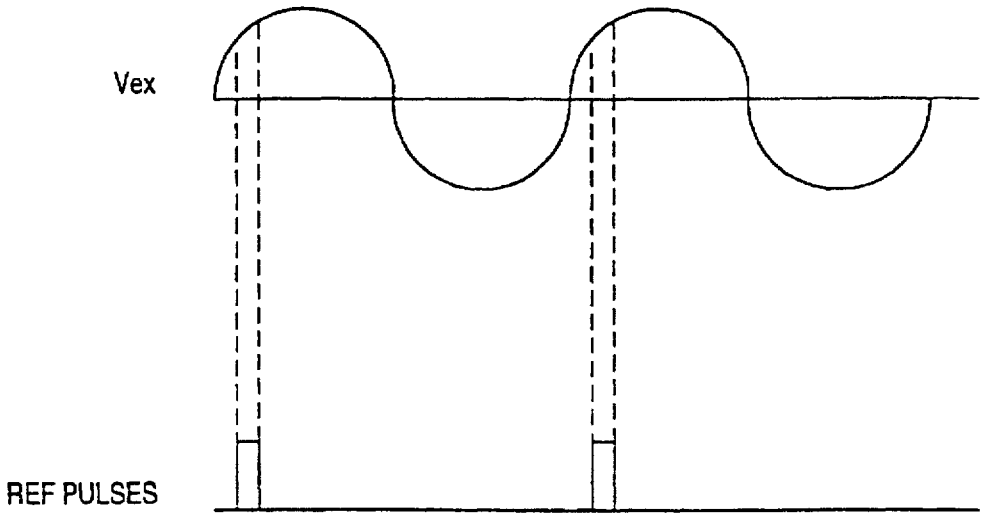
FIG. 12B is a waveform diagram of the input signals supplied to the circuit of FIG. 13A.

FIGS. 12A and 12B illustrate a preferred phase-sensitive detector 250 for sampling the differential output signal $V_{diff}$ from the two detector coils 222, 224. The differential output signal $V_{diff}$ is passed through a buffer amplifier 252 to a switch 254, where the buffered $V_{diff}$ is sampled once per cycle by momentarily closing the switch 254. The switch 254 is controlled by a series of reference pulses produced from the $V_{ex}$ signal, one pulse per cycle. The reference pulses 258 are synchronized with excitation voltage $V_{ex}$, so that the amplitude of the differential output signal $V_{diff}$ during the sampling interval is a function not only of the amplitude of the detector coil voltages 236, 238, but also of the phase difference between the signals in excitation coil 212 and the detection coils 236, 238.

The pulses derived from $V_{ex}$ are delayed by an "offset angle" which can be adjusted to minimize the sensitivity of $V_{diff}$ to variations in the gap between the proximal face of the sensor 210 and the surface of the coin 214 being sensed. The value of the offset angle for any given coin can be determined empirically by moving a standard metal disc, made of the same material as the coin 214, from a position where it contacts the sensor face, to a position where it is spaced about 0.001 to 0.020 inch from the sensor face. The signal sample from the detector 250 is measured at both positions, and the difference between the two measurements is noted. This process is repeated at several different offset angles to determine the offset angle which produces the minimum difference between the two measurements.

Each time buffered $V_{diff}$ is sampled, the resulting sample is passed through a second buffer amplifier 256 to an analog-to-digital converter (not shown). The resulting digital value is supplied to a microprocessor (not shown) which compares that value with several different ranges of values stored in a lookup table (not shown). Each stored range of values corresponds to a particular coin material, and thus the coin material represented by any given sample value is determined by the particular stored range into which the sample value falls. The stored ranges of values can be determined empirically by simply measuring a batch of coins of each denomination and storing the resulting range of values measured for each denomination.

I claim:

1. A coin discrimination sensor for discriminating among desired and undesired coins, comprising:

an excitation coil and a voltage source connected thereto for producing an alternating magnetic field;

said alternating magnetic fields coupling to said desired and undesired coins to induce eddy-currents in said coins;

a detection coil having a pair of windings for detecting said eddy currents in said desired and undesired coins, said windings being positioned at different distances from said coins to produce a differential voltage across said detection coil corresponding to the composition of the desired and undesired coins being sensed, said excitation coil and said detection coil being both located on the same side of and above the coin being sensed, means for producing a single signal representing both the amplitude of the voltage produced by said detection coil and the phase difference between the voltage applied to the excitation coil and the differential voltage induced in the detection coil, and wherein said means for detecting a phase difference between the voltage applied to the excitation coil and the differential voltage induced in the detection coil detects the amplitude of said differential voltage.

2. The coin discrimination sensor of claim 1 which includes signal processing means for analyzing the differential voltage produced by said detection coil to discriminate between desired and undesired coins.

3. The coin discrimination sensor of claim 2 wherein said signal processing means includes means for detecting both the amplitude of the signal produced by said detection coil and any phase difference between the voltage that energizes said excitation coil and the signal produced by said detection coil.

4. A disc-type coin sorter comprising a rotatable disk having a resilient upper surface;

a stationary sorting head mounted over said rotatable disk, said sorting head having a lower surface generally parallel to and spaced slightly from said resilient upper surface of said rotatable disk for carrying coins along the lower surface of said sorting head, said lower surface defining a plurality of coin denomination exit channels for sorting said coins by denomination and discharging said coins;

a coin discrimination sensor mounted in each of said exit channels for discriminating among desired and undesired ones of the sorted coins in the respective exit channels, said sensor comprising an excitation coil and a voltage source connected thereto for producing an alternating magnetic field coupling to coins passing directly beneath the sensor to induce eddy currents in such coins, and a detection coil for detecting the eddy currents induced in said coins and producing electrical signals corresponding to said eddy currents, and signal processing means for analyzing the signals produced by said detection coil to discriminate between desired and undesired coins.

5. The disc-type coin sorter of claim 4 further comprising means for interrupting rotation of said rotatable disc in response to detection of an undesired coin to permit removal of said undesired coin.

6. A disc-type coin sorter comprising a rotatable disk having a resilient upper surface;

a stationary sorting head mounted over said rotatable disk, said sorting head having a lower surface generally parallel to and spaced slightly from said resilient upper surface of said rotatable disk for carrying coins along the lower surface of said sorting head, said lower surface defining a plurality of coin denomination exit channels for sorting said coins by denomination and discharging said coins;

a coin discrimination sensor mounted in each of said exit channels for discriminating among desired and undesired ones of the sorted coins in the respective exit channels, said sensor comprising an excitation coil and a voltage source connected thereto for producing a single alternating magnetic field coupling to coins passing directly beneath the sensor to induce eddy currents in such coins, said voltage source produces an alternating voltage at a frequency of about 250 KHz, and a detection coil for detecting the eddy currents induced in said coins and producing electrical signals corresponding to said eddy currents, and signal processing means for analyzing the signals produced by said detection coil to discriminate between desired and undesired coins.

7. The disc-type coin sorter of claim 6 further comprising means for interrupting rotation of said rotatable disc in response to detection of an undesired coin to permit removal of said undesired coin.

* * * * *